US011705043B2

(12) United States Patent
Dai et al.

(10) Patent No.: US 11,705,043 B2
(45) Date of Patent: Jul. 18, 2023

(54) DISPLAY PANEL

(71) Applicant: WUHAN CHINA STAR OPTOELECTRONICS TECHNOLOGY CO., LTD., Hubei (CN)

(72) Inventors: Ronglei Dai, Hubei (CN); Zuoyuan Xu, Hubei (CN)

(73) Assignee: WUHAN CHINA STAR OPTOELECTRONICS TECHNOLOGY CO., LTD., Hubei (CN)

( * ) Notice: Subject to any disclaimer, the term of this patent is extended or adjusted under 35 U.S.C. 154(b) by 0 days.

(21) Appl. No.: 16/766,832

(22) PCT Filed: Mar. 24, 2020

(86) PCT No.: PCT/CN2020/080928
§ 371 (c)(1),
(2) Date: May 26, 2020

(87) PCT Pub. No.: WO2021/128616
PCT Pub. Date: Jul. 1, 2021

(65) Prior Publication Data

US 2022/0351663 A1 Nov. 3, 2022

(30) Foreign Application Priority Data

Dec. 23, 2019 (CN) ..... 201911338745.8

(51) Int. Cl.
*G09G 3/20* (2006.01)

(52) U.S. Cl.
CPC ... *G09G 3/2003* (2013.01); *G09G 2300/0408* (2013.01); *G09G 2300/0443* (2013.01);
(Continued)

(58) Field of Classification Search
CPC ..... G09G 3/2003; G09G 2300/0443; G09G 2300/0408; G09G 2300/0452;
(Continued)

(56) References Cited

U.S. PATENT DOCUMENTS 6,700,562 B1 3/2004 Knapp et al.
2011/0175858 A1 7/2011 Lee et al.
(Continued)

FOREIGN PATENT DOCUMENTS

CN 102866551 A 1/2013
CN 103943090 A 7/2014
(Continued)

*Primary Examiner* — Kenneth B Lee, Jr.
(74) *Attorney, Agent, or Firm* — PV IP PC; Wei Te Chung; Zhigang Ma

(57) ABSTRACT

A display panel includes an array substrate, a plurality of cascading GOA units, a plurality of DEMUX switching units, and a DEMUX control signal generating circuit. One DEMUX switching unit includes a scanning signal input port, at least two control signal input ports, and at least two scanning signal output ports. One GOA unit is connected to the scanning signal input port, the DEMUX control signal generating circuit is connected to the at least two control signal input ports, and the scanning signal output ports are connected to corresponding gate lines.

14 Claims, 3 Drawing Sheets

(52) U.S. Cl.
CPC ..... *G09G 2300/0452* (2013.01); *G09G 2310/0297* (2013.01); *G09G 2310/08* (2013.01); *G09G 2340/0457* (2013.01)

(58) Field of Classification Search
CPC ..... G09G 2310/0297; G09G 2310/08; G09G 2340/0457
See application file for complete search history.

(56) References Cited

U.S. PATENT DOCUMENTS

| | | | | |
|---|---|---|---|---|
| 2014/0104148 | A1 | 4/2014 | Wang | |
| 2015/0295575 | A1 | 10/2015 | Lee | |
| 2017/0076665 | A1 | 3/2017 | Kim | |
| 2018/0267377 | A1 | 9/2018 | Ying et al. | |
| 2019/0079331 | A1* | 3/2019 | Miyamoto ..... | H01L 27/1248 |
| 2019/0385558 | A1* | 12/2019 | Chen ..... | G11C 19/28 |

FOREIGN PATENT DOCUMENTS

| | | | |
|---|---|---|---|
| CN | 106782404 | A | 5/2017 |
| EP | 1055219 | A1 | 11/2000 |
| KR | 20140093357 | A | 7/2014 |

* cited by examiner

DISPLAY PANEL

FIELD OF INVENTION

The present disclosure relates to the field of display technologies, and more particularly, to a display panel.

BACKGROUND OF INVENTION

Current low temperature polysilicon (LTPS) display products usually use a demultiplexer (DEMUX) design to achieve a narrow lower frame design in a source electrode driving circuit. A DEMUX multiplexed driving circuit is configured to divide a signal into multiple signal channels, thereby reducing a number of data lines in the source electrode driving circuit. However, as demands for picture quality of displays increase, high resolutions and narrow frames have become a development trend in future display panel industry. Current DEMUX circuit designs cannot further narrow lower frames under a condition of improving resolutions of displays, so it is difficult to achieve a narrower frame display design.

Technical problem: an embodiment of the present disclosure provides a display panel to solve the technical problem of inability to further reduce lower frames under the condition of improving resolutions of displays in DEMUX circuit designs of current display panels.

SUMMARY OF INVENTION

To solve the above problems, an embodiment of the present disclosure provides technical solutions as follows:

An embodiment of the present disclosure provides a display panel which comprises an array substrate, a plurality of cascading gate driver on array (GOA, array substrate row driving) units, a plurality of DEMUX switching units, and a DEMUX control signal generating circuit. The array substrate includes a plurality of data lines and a plurality of gate lines interlaced with the data lines, and a plurality of pixel areas formed by interlacing the data lines and the gate lines, wherein each pixel area corresponds to form a sub-pixel. The plurality of DEMUX switching units are correspondingly connected to the plurality of GOA units by one to one, and the DEMUX control signal generating circuit is connected to the plurality of DEMUX switching units. Wherein, one DEMUX switching unit comprises a scanning signal input port, three control signal input ports, and three scanning signal output ports; one GOA unit is connected to the scanning signal input port to send a scanning signal to the DEMUX switching unit, the DEMUX control signal generating circuit is connected to the at least two control signal input ports to send a control signal to the DEMUX switching unit, and the scanning signal output ports are connected to the corresponding gate lines; and the display panel comprises a plurality of pixels, taking an extending direction of the gate lines as a row direction and an extending direction of the data lines as a column direction, one pixel comprises a first sub-pixel, a second sub-pixel, and a third sub-pixel arranged along the column direction, and a plurality of sub-pixels of each row have a same color.

In at least one embodiment of the present disclosure, each DEMUX switching unit comprises a first thin film transistor, a second thin film transistor, and a third thin film transistor.

In at least one embodiment of the present disclosure, the DEMUX control signal generating circuit comprises a first branched control signal line, a second branched control signal line, and a third branched control signal line all connected to the DEMUX switching units.

In at least one embodiment of the present disclosure, the first branched control signal line is connected to one of a source electrode or a drain electrode of the first thin film transistor, the second branched control signal line is connected to one of a source electrode or a drain electrode of the second thin film transistor, and the third branched control signal line is connected to one of a source electrode or a drain electrode of the third thin film transistor.

In at least one embodiment of the present disclosure, the GOA unit is connected to gate electrodes of the first thin film transistor, the second thin film transistor, and the third thin film transistor of the DEMUX switching unit through the scanning signal input port.

In at least one embodiment of the present disclosure, polarities of two adjacent sub-pixels of each row are different, and polarities of two adjacent sub-pixels of each column are different.

In at least one embodiment of the present disclosure, the two adjacent sub-pixels in a same column are driven by two different data lines, and the plurality of sub-pixels having a same polarity in the same column are driven by a same data line.

In at least one embodiment of the present disclosure, polarities of driving signals of two adjacent data lines are different.

In at least one embodiment of the present disclosure, the plurality of GOA units and the DEMUX control signal generating circuit are integrated into one drive chip.

An embodiment of the present disclosure further provides a display panel which comprises an array substrate, a plurality of cascading gate driver on array (GOA, array substrate row driving) units, a plurality of DEMUX switching units, and a DEMUX control signal generating circuit. The array substrate includes a plurality of data lines and a plurality of gate lines interlaced with the data lines, and a plurality of pixel areas formed by interlacing the data lines and the gate lines, wherein each pixel area corresponds to form a sub-pixel. The plurality of DEMUX switching units are correspondingly connected to the plurality of GOA units by one to one, and the DEMUX control signal generating circuit is connected to the plurality of DEMUX switching units. Wherein, one DEMUX switching unit comprises a scanning signal input port, at least two control signal input ports, and at least two scanning signal output ports; and one GOA unit is connected to the scanning signal input port to send a scanning signal to the DEMUX switching unit, the DEMUX control signal generating circuit is connected to the at least two control signal input ports to send a control signal to the DEMUX switching unit, and the scanning signal output ports are connected to the corresponding gate lines.

In at least one embodiment of the present disclosure, the DEMUX switching unit comprises three control signal input ports and three scanning signal output ports.

In at least one embodiment of the present disclosure, each DEMUX switching unit comprises a first thin film transistor, a second thin film transistor, and a third thin film transistor.

In at least one embodiment of the present disclosure, the DEMUX control signal generating circuit comprises a first branched control signal line, a second branched control signal line, and a third branched control signal line all connected to the DEMUX switching units.

In at least one embodiment of the present disclosure, the first branched control signal line is connected to one of a source electrode or a drain electrode of the first thin film transistor, the second branched control signal line is connected to one of a source electrode or a drain electrode of the second thin film transistor, and the third branched control signal line is connected to one of a source electrode or a drain electrode of the third thin film transistor.

In at least one embodiment of the present disclosure, the GOA unit is connected to gate electrodes of the first thin film transistor, the second thin film transistor, and the third thin film transistor of the DEMUX switching unit through the scanning signal input port.

In at least one embodiment of the present disclosure, the display panel comprises a plurality of pixels, taking an extending direction of the gate lines as a row direction and an extending direction of the data lines as a column direction, one pixel comprises a first sub-pixel, a second sub-pixel, and a third sub-pixel arranged along the column direction, and a plurality of sub-pixels of each row have a same color.

In at least one embodiment of the present disclosure, polarities of two adjacent sub-pixels of each row are different, and polarities of two adjacent sub-pixels of each column are different.

In at least one embodiment of the present disclosure, the two adjacent sub-pixels in a same column are driven by two different data lines, and the plurality of sub-pixels having a same polarity in the same column are driven by a same data line.

In at least one embodiment of the present disclosure, polarities of driving signals of two adjacent data lines are different.

In at least one embodiment of the present disclosure, the plurality of GOA units and the DEMUX control signal generating circuit are integrated into one drive chip.

Beneficial effect: the present disclosure can save lower frame space by removing a DEMUX switching design in a source electrode driving circuit. In addition, the present disclosure adds DEMUX switches in a gate electrode driving circuit and has a horizontal design of sub-pixels, which allows signals of gate electrodes to output by gradation and achieves a dot inversion driving mode when normal display function is ensured, thereby improving display quality.

DESCRIPTION OF DRAWINGS

The accompanying figures to be used in the description of embodiments of the present disclosure or prior art will be described in brief to more clearly illustrate the technical solutions of the embodiments or the prior art. The accompanying figures described below are only part of the embodiments of the present disclosure, from which figures those skilled in the art can derive further figures without making any inventive efforts.

DETAILED DESCRIPTION OF PREFERRED EMBODIMENTS

Figure 1:
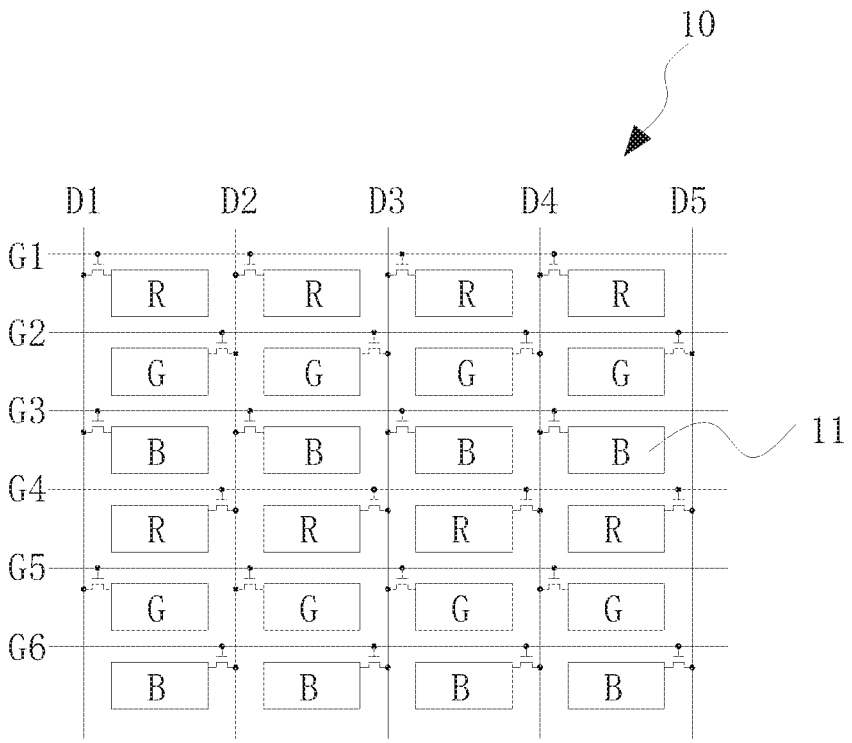
FIG. 1 is a schematic structural diagram of an array substrate according to an embodiment of the present disclosure.

The technical solutions in the embodiments of the present disclosure will be clearly and completely described below with reference to the drawings in the embodiments of the present disclosure. Obviously, the described embodiments are only a part of the embodiments of the present disclosure, but not all the embodiments. Based on the embodiments in the present disclosure, all other embodiments obtained by those skilled in the art without creative efforts are within the scope of the present disclosure.

In the description of the present disclosure, it should be understood that terms such as "center", "longitudinal", "lateral", "length", "width", "thickness", "upper", "lower", "front", "rear", "left", "right", "vertical", "horizontal", "top", "bottom", "inside", "outside", "clockwise", "counter-clockwise", as well as derivative thereof should be construed to refer to the orientation as described or as shown in the drawings under discussion. These relative terms are for convenience of description, do not require that the present disclosure be constructed or operated in a particular orientation, and shall not be construed as causing limitations to the present disclosure. In addition, terms such as "first" and "second" are used herein for purposes of description and are not intended to indicate or imply relative importance or implicitly indicating the number of technical features indicated. Thus, features limited by "first" and "second" are intended to indicate or imply including one or more than one these features. In the description of the present disclosure, "a plurality of" relates to two or more than two, unless otherwise specified.

In the description of the present disclosure, it should be noted that unless there are express rules and limitations, the terms such as "mount," "connect," and "bond" should be comprehended in broad sense. For example, it can mean a permanent connection, a detachable connection, or an integrate connection; it can mean a mechanical connection, an electrical connection, or can communicate with each other; it can mean a direct connection, an indirect connection by an intermediate, or an inner communication or an inter-reaction between two elements. A person skilled in the art should understand the specific meanings in the present disclosure according to specific situations.

In the description of the present disclosure, unless specified or limited otherwise, it should be noted that, a structure in which a first feature is "on" or "beneath" a second feature may include an embodiment in which the first feature directly contacts the second feature and may also include an embodiment in which an additional feature is formed between the first feature and the second feature so that the first feature does not directly contact the second feature. Furthermore, a first feature "on," "above," or "on top of" a second feature may include an embodiment in which the first feature is right "on," "above," or "on top of" the second feature and may also include an embodiment in which the first feature is not right "on," "above," or "on top of" the second feature, or just means that the first feature has a sea level elevation greater than the sea level elevation of the second feature. While first feature "beneath," "below," or "on bottom of" a second feature may include an embodiment in which the first feature is right "beneath," "below," or "on bottom of" the second feature and may also include an embodiment in which the first feature is not right "beneath," "below," or "on bottom of" the second feature, or just means that the first feature has a sea level elevation less than the sea level elevation of the second feature.

The following description provides many different embodiments or examples for implementing different structures of the present disclosure. In order to simplify the present disclosure, the components and settings of a specific example are described below. Of course, they are merely examples and are not intended to limit the present disclosure. In addition, the present disclosure may repeat reference numerals and/or reference letters in different examples, which are for the purpose of simplicity and clarity, and do not indicate the relationship between the various embodiments and/or arrangements discussed. In addition, the present disclosure provides examples of various specific processes and materials, but one of ordinary skill in the art will recognize the use of other processes and/or the use of other materials.

Figure 2:
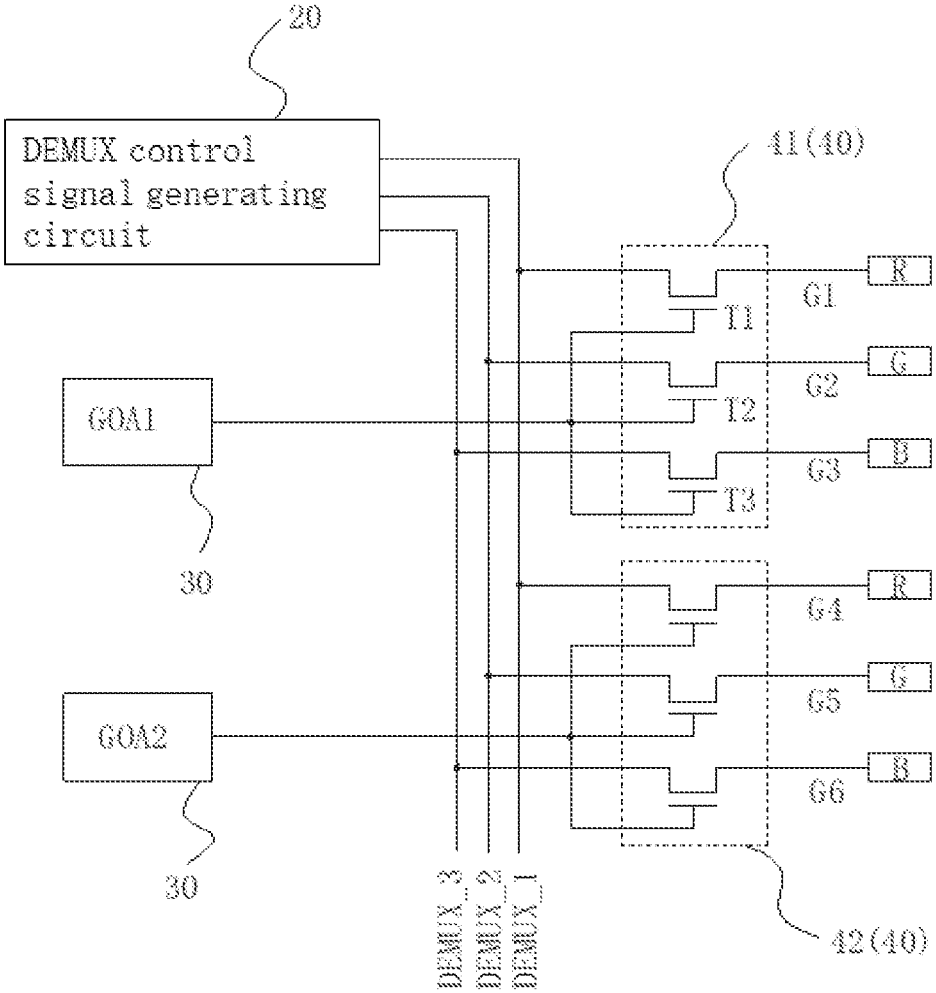
FIG. 2 is a schematic driving principle diagram of a display panel according to an embodiment of the present disclosure.

As shown in FIGS. 1 and 2, an embodiment of the present disclosure provides a display panel which comprises an array substrate 10, a plurality of cascading gate driver on array (GOA, array substrate row driving) units 30, a DEMUX control signal generating circuit 20, and a plurality of DEMUX switching units 40.

The plurality of DEMUX switching units 40 are correspondingly connected to the plurality of GOA units 30 by one to one, and the DEMUX control signal generating circuit 20 is connected to the plurality of DEMUX switching units 40.

Wherein, one DEMUX switching unit 40 comprises a scanning signal input port, at least two control signal input ports, and at least two scanning signal output ports.

The array substrate 10 includes a plurality of data lines and a plurality of gate lines interlaced with the data lines, and a plurality of pixel areas formed by interlacing the data lines and the gate lines, wherein each pixel area corresponds to form a sub-pixel 11.

One GOA unit 30 is connected to the scanning signal input port to send a scanning signal to the DEMUX switching unit 40.

The DEMUX control signal generating circuit 20 is connected to the at least two control signal input ports to send a control signal to the DEMUX switching unit 40. The DEMUX control signal generating circuit 20 generates the control signal to divide the scanning signal from the GOA unit 30 into at least two signal channels, and divided scanning signals are written into corresponding sub-pixels through the at least two control signal input ports and the DEMUX switching unit 40.

The at least two scanning signal output ports are connected to corresponding gate lines to load the output scanning signals to the corresponding gate lines, thereby achieving charging of pixels.

The embodiment of the present disclosure only shows two GOA units (GOA1 and GOA2), but is not limited to this. Correspondingly, the DEMUX switching units shown are a first DEMUX switching unit 41 and a second DEMUX switching unit 42. GOA1 is connected to the first DEMUX switching unit 41, and GOA2 is connected to the second DEMUX switching unit 42.

As shown in FIG. 2, the embodiment of the present disclosure takes three control signal input ports and three scanning signal output ports as an example for illustration, but is not limited to this. The DEMUX switching unit 40 can also comprise two control signal input ports and two scanning signal output ports, or four control signal input ports and four scanning signal output ports.

The DEMUX control signal generating circuit 20 comprises a first branched control signal line DEMUX_1, a second branched control signal line DEMUX_2, and a third branched control signal line DEMUX_3 all connected to the plurality of DEMUX switching units 40.

The three branched control signal lines (DEMUX_1, DEMUX_2, and DEMUX_3) of the DEMUX control signal generating circuit 20 are connected to the three control signal input ports of each DEMUX switching unit, thereby dividing the scanning signal of the GOA unit into three scanning signal channels, which are input to a corresponding gate line through one of the scanning signal output ports of the DEMUX switching unit 40, thereby turning on a corresponding switch of a sub-pixel and charging the sub-pixel.

Specifically, each DEMUX switching unit 40 comprises a first thin film transistor T1, a second thin film transistor T2, and a third thin film transistor T3.

The first branched control signal line DEMUX_1 is connected to one of a source electrode or a drain electrode of the first thin film transistor T1, the second branched control signal line DEMUX_2 is connected to one of a source electrode or a drain electrode of the second thin film transistor T2, and the third branched control signal line DEMUX_3 is connected to one of a source electrode or a drain electrode of the third thin film transistor T3. The other source electrodes or drain electrodes of the three thin film transistors are individually connected to three corresponding gate lines.

The GOA unit 30 is connected to gate electrodes of the first thin film transistor T1, the second thin film transistor T2, and the third thin film transistor T3 of the DEMUX switching unit 40 through the scanning signal input port.

Taking GOA1 for example, the scanning signal input port of the first DEMUX switching unit 41 is connected to GOA1, the scanning signal input port is connected to the gate electrode of the first thin film transistor T1, the gate electrode of the second thin film transistor T2, and the gate electrode of the third thin film transistor T3, the source electrode or the drain electrode of the first thin film transistor T1 is connected to a gate line G1, the source electrode or the drain electrode of the second thin film transistor T2 is connected to a gate line G2, and the source electrode or the drain electrode of the third thin film transistor T3 is connected to a gate line G3.

For example, when GOA1 is at a high potential, the first thin film transistor T1, the second thin film transistor T2, and the third thin film transistor T3 are turned on, and when the DEMUX control signal generating circuit 20 generates a first control signal, the first control signal is transmitted from the first branched control signal line DEMUX_1 to the source electrode or the drain electrode of the first thin film transistor T1, which makes the control signal input port and the scanning signal output port of the first thin film transistor T1 connected, that is, the source electrode and the drain electrode of the first thin film transistor T1 are connected, thereby allowing the scanning signal to be transmitted to the gate line G1 and charging a corresponding sub-pixel 11.

As shown in FIG. 1, an extending direction of the gate lines is taken as a row direction, and an extending direction of the data lines is taken as a column direction. The display panel further comprises a plurality of pixels. One pixel comprises a first sub-pixel, a second sub-pixel, and a third sub-pixel. The first sub-pixel, the second sub-pixel, and the third sub-pixel are arranged along the column direction (that is, the pixels are arranged in the horizontal direction). The first sub-pixel, the second sub-pixel, and the third sub-pixel individually correspond to one of red (R) sub-pixel, green (G) sub-pixel, or blue (B) sub-pixel. In the embodiment, the first sub-pixel is an R sub-pixel, the second sub-pixel is a G sub-pixel, and the third sub-pixel is a B sub-pixel.

One gate line is connected to a row of sub-pixels 11, and the sub-pixels 11 in a same row have a same color.

One GOA unit 30 corresponds to a row of pixels, that is, one GOA unit 30 scans three rows of sub-pixels. For example, GOA1 corresponds to the gate lines G1, G2, and G3, and GOA1 scans row sub-pixels corresponding to the gate lines G1, G2, and G3 in sequence; GOA2 corresponds to gate lines G4, G5, and G6, and GOA2 scans row sub-pixels corresponding to the gate lines G4, G5, and G6 in sequence.

The display panel in the embodiment can be a liquid crystal display panel, and a driven method thereof can be a dot inversion driving mode. In other embodiments, the display panel can be an OLED display panel, and a driven method thereof can be a column inversion mode or a row inversion mode, which is not limited herein.

As shown in FIG. 1, polarities of two adjacent sub-pixels 11 of each row are different, and polarities of two adjacent sub-pixels 11 of each column are different.

Specifically, a column of sub-pixels 11 can be driven by a data line. However, because polarities of two adjacent sub-pixels in a same column are opposite, power consumption will be larger if a column of sub-pixels 11 are driven by a same data line. Therefore, two of the adjacent sub-pixels 11 in the same column can be driven by two different data lines, and the plurality of sub-pixels 11 having a same polarity in the same column are driven by a same data line.

Polarities of driving signals of two adjacent data lines can be opposite. For example, driving signals of data lines D1, D3, and D5 have a positive polarity, and driving signals of data lines D2 and D4 have a negative polarity.

As shown in FIG. 1, taking the data line D1 and the data line D2 for example, the data line D1 is connected to an R sub-pixel in the first column and first row, a B sub-pixel in the first column and third row, and a G sub-pixel in the first column and fifth row, and charges the above sub-pixels; the data line D2 is connected to an R sub-pixel in the second column and first row, a G sub-pixel in the first column and second row, a B sub-pixel in the second column and third row, an R sub-pixel in the first column and fourth row, a G sub-pixel in the second column and fifth row, and a B sub-pixel in the first column and sixth row, and charges the above sub-pixels.

The plurality of GOA units 30 and the DEMUX control signal generating circuit 20 can be integrated into one drive chip to further save space, thereby reducing the lower frame of the display panel.

Figure 3:
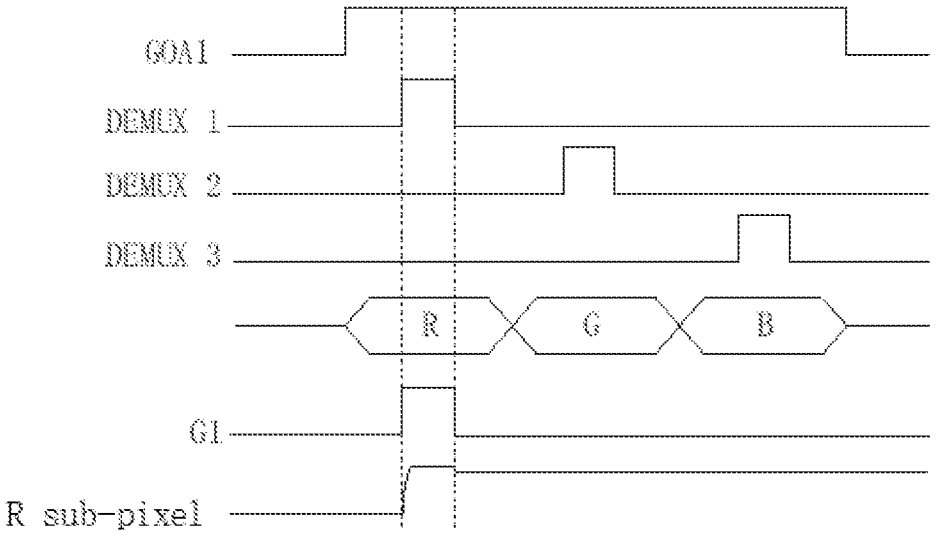
FIG. 3 is a driving timing diagram of a display panel according to an embodiment of the present disclosure.

As shown in FIG. 3, the DEMUX control signal generating circuit 20 gives high electrical potentials at different time periods, thereby controlling the scanning signal of the GOA unit 30 to be given to a corresponding gate line.

Signals generated by the DEMUX control signal generating circuit 20 comprises a first control signal, a second control signal, and a third control signal. Wherein, the first control signal is transmitted to the first branched control signal line DEMUX_1, the second control signal is transmitted to the second branched control signal line DEMUX_2, and the third control signal is transmitted to the third branched control signal line DEMUX_3.

Taking GOA1 for example, GOA1 is continuously at the high potential during a period of charging the corresponding sub-pixels (the sub-pixels of the first row to the third row), which makes the correspondingly connected first thin film transistor T1, second thin film transistor T2, and third thin film transistor T3 in a turned-on state. When pixels corresponding to the gate line G1 need to be charged, the first control signal becomes an effective signal having the high electrical potential, a scanning signal is transmitted from the first thin film transistor T1 to the gate line G1 having the high electrical potential, the scanning signal is written into the first row of sub-pixels corresponding to the gate line G1, and the data lines D1 to D5 corresponding to the row of sub-pixels charge corresponding sub-pixels. At this time, the second control signal and the third control signal are at a low electrical potential.

After charging the first row of sub-pixels, the second control signal is at the high electrical potential, a scanning signal is transmitted from the second thin film transistor T2 to the gate line G2 having the high electrical potential, the scanning signal is written into the second row of sub-pixels corresponding to the gate line G2, and the data lines D1 to D5 corresponding to the row of sub-pixels charge corresponding sub-pixels. At this time, the first control signal and the third control signal are at the low electrical potential, and the gate line G1 is at the low electrical potential.

After charging the second row of sub-pixels, the third control signal is at the high electrical potential, a scanning signal is transmitted from the third thin film transistor T3 to the gate line G3 having the high electrical potential, the scanning signal is written into the third row of sub-pixels corresponding to the gate line G3, and the data lines D1 to D5 corresponding to the row of sub-pixels charge corresponding sub-pixels. At this time, the first control signal and the second control signal are at the low electrical potential, and the gate lines G1 and G2 are at the low electrical potential. The above sequence completes the progressive scanning of the GOA unit.

When charging the three rows of sub-pixels corresponding to GOA1, FIG. 3 shows a charging state of pixels having two different polarities. That is, an R sub-pixel having the positive polarity, a G sub-pixel having the negative polarity, and a B sub-pixel having the positive polarity; and an R sub-pixel having the negative polarity, a G sub-pixel having the positive polarity, and a B sub-pixel having the negative polarity.

A scan timing of the gate line G1 is same as a generating timing of the first control signal, a scan timing of the gate line G2 is same as a generating timing of the second control signal, and a scan timing of the gate line G3 is same as a generating timing of the third control signal.

The charging timing of an R sub-pixel in FIG. 3 is the charging timing of the R sub-pixel in the first row and first column. After charging, a pixel voltage of the sub-pixel will be coupled down due to presence of a feedthrough voltage to make an original balanced common electrode voltage to shift. The effect of feedthrough voltage on display can be reduced by designing a feedthrough voltage compensating circuit unit, which can refer to current technology for details.

Beneficial effect: the present disclosure can save lower frame space by removing a DEMUX switching design in a source electrode driving circuit. In addition, the present disclosure adds DEMUX switches in a gate electrode driving circuit and has a horizontal design of sub-pixels, which allows signals of gate electrodes to output by gradation and achieves a dot inversion driving mode when normal display function is ensured, thereby improving display quality.

In the above embodiments, the description of each embodiment has its own emphasis. For the parts that are not described in detail in an embodiment, can refer to the detailed description of other embodiments above.

The display panel provided by the present disclosure are described in detail above. The specific examples are applied in the description to explain the principle and implementation of the disclosure. The description of the above embodiments is only for helping to understand the technical solution of the present disclosure and its core ideas, and it is understood that many changes and modifications to the described embodiment can be carried out without departing from the scope and the spirit of the disclosure that is intended to be limited only by the appended claims.

What is claimed is:

1. A display panel, comprising:

an array substrate including a plurality of data lines and a plurality of gate lines interlaced with the data lines, and a plurality of pixel areas formed by interlacing the data lines and the gate lines, wherein each pixel area corresponds to form a sub-pixel;

a plurality of cascading gate driver on array (GOA) units disposed on the array substrate;

a plurality of demultiplexer (DEMUX) switching units correspondingly connected to the plurality of GOA units by one to one, each DEMUX switching unit comprises a first thin film transistor, a second thin film transistor, and a third thin film transistor; and a DEMUX control signal generating circuit connected to the plurality of DEMUX switching units;

wherein one DEMUX switching unit comprises a scanning signal input port, three control signal input ports, and three scanning signal output ports;

one GOA unit is connected to the scanning signal input port to send a scanning signal to the DEMUX switching unit, the DEMUX control signal generating circuit is connected to the three control signal input ports to send a control signal to the DEMUX switching unit, and the scanning signal output ports are connected to the corresponding gate lines; the GOA unit is connected to gate electrodes of the first thin film transistor, the second thin film transistor, and the third thin film transistor of the DEMUX switching unit through the scanning signal input port; and the display panel comprises a plurality of pixels, taking an extending direction of the gate lines as a row direction and an extending direction of the data lines as a column direction, wherein one pixel comprises a first sub-pixel, a second sub-pixel, and a third sub-pixel arranged along the column direction, and a plurality of sub-pixels of each row have a same color.

2. The display panel according to claim 1, wherein the DEMUX control signal generating circuit comprises a first branched control signal line, a second branched control signal line, and a third branched control signal line all connected to the DEMUX switching units.

3. The display panel according to claim 2, wherein the first branched control signal line is connected to one of a source electrode or a drain electrode of the first thin film transistor, the second branched control signal line is connected to one of a source electrode or a drain electrode of the second thin film transistor, and the third branched control signal line is connected to one of a source electrode or a drain electrode of the third thin film transistor.

4. The display panel according to claim 1, wherein polarities of two adjacent sub-pixels of each row are different, and polarities of two adjacent sub-pixels of each column are different.

5. The display panel according to claim 4, wherein the two adjacent sub-pixels in a same column are driven by two different data lines, and the plurality of sub-pixels having a same polarity in the same column are driven by a same data line.

6. The display panel according to claim 4, wherein polarities of driving signals of two adjacent data lines are different.

7. A display panel, comprising:

an array substrate including a plurality of data lines and a plurality of gate lines interlaced with the data lines, and a plurality of pixel areas formed by interlacing the data lines and the gate lines, wherein each pixel area corresponds to form a sub-pixel;

a plurality of cascading gate driver on array (GOA) units disposed on the array substrate;

a plurality of demultiplexer (DEMUX) switching units correspondingly connected to the plurality of GOA units by one to one, each DEMUX switching unit comprises a first thin film transistor, a second thin film transistor, and a third thin film transistor; and a DEMUX control signal generating circuit connected to the plurality of DEMUX switching units;

wherein one DEMUX switching unit comprises a scanning signal input port, at least two control signal input ports, and at least two scanning signal output ports; and one GOA unit is connected to the scanning signal input port to send a scanning signal to the DEMUX switching unit, the DEMUX control signal generating circuit is connected to the at least two control signal input ports to send a control signal to the DEMUX switching unit, and the scanning signal output ports are connected to the corresponding gate lines; the GOA unit is connected to gate electrodes of the first thin film transistor, the second thin film transistor, and the third thin film transistor of the DEMUX switching unit through the scanning signal input port.

8. The display panel according to claim 7, wherein the DEMUX switching unit comprises three control signal input ports and three scanning signal output ports.

9. The display panel according to claim 7, wherein the DEMUX control signal generating circuit comprises a first branched control signal line, a second branched control signal line, and a third branched control signal line all connected to the DEMUX switching units.

10. The display panel according to claim 9, wherein the first branched control signal line is connected to one of a source electrode or a drain electrode of the first thin film transistor, the second branched control signal line is connected to one of a source electrode or a drain electrode of the second thin film transistor, and the third branched control signal line is connected to one of a source electrode or a drain electrode of the third thin film transistor.

11. The display panel according to claim 7, comprising a plurality of pixels, taking an extending direction of the gate lines as a row direction and an extending direction of the data lines as a column direction, wherein one pixel comprises a first sub-pixel, a second sub-pixel, and a third sub-pixel arranged along the column direction, and a plurality of sub-pixels of each row have a same color.

12. The display panel according to claim 11, wherein polarities of two adjacent sub-pixels of each row are different, and polarities of two adjacent sub-pixels of each column are different.

13. The display panel according to claim 12, wherein the two adjacent sub-pixels in a same column are driven by two different data lines, and the plurality of sub-pixels having a same polarity in the same column are driven by a same data line.

14. The display panel according to claim 12, wherein polarities of driving signals of two adjacent data lines are different.

* * * * *